US005331523A

United States Patent [19]

Delzer

[11] Patent Number: 5,331,523

[45] Date of Patent: Jul. 19, 1994

[54] GAS DISPENSING FLASHLIGHT APPARATUS

[76] Inventor: David G. Delzer, 1866 Vining Dr., San Leandro, Calif. 94579

[21] Appl. No.: 88,372

[22] Filed: Jul. 9, 1993

[51] Int. Cl.[5] ..... F21V 33/00

[52] U.S. Cl. ..... 362/96; 362/253; 222/3; 222/192

[58] Field of Search ..... 42/1.08; 222/3, 192, 222/402.11, 402.13; 362/96, 202, 208, 253, 113, 114

[56] References Cited

U.S. PATENT DOCUMENTS

| | | | |
|---|---|---|---|
| 2,855,497 | 10/1958 | Bacon | 362/96 |
| 3,716,170 | 2/1973 | Mangels | 362/96 |
| 3,776,429 | 12/1973 | DeLucia | 362/96 |
| 4,044,712 | 8/1977 | Goodman et al. | 222/3 |
| 4,153,927 | 5/1979 | Owens | 362/253 |
| 4,186,851 | 2/1980 | Cantor | 362/113 |
| 4,223,804 | 9/1980 | Morris et al. | 42/1.08 |
| 4,434,914 | 3/1984 | Meshberg | 222/192 |
| 5,086,377 | 2/1992 | Roberts | 362/102 |

*Primary Examiner*—Ira S. Lazarus
*Assistant Examiner*—Alan B. Cariaso
*Attorney, Agent, or Firm*—E. Michael Combs

[57] ABSTRACT

A flashlight having a primary housing includes an illumination bulb operative through a switch member relative to the housing, wherein a secondary housing arranged parallel to the access of the first primary housing in contiguous communication therewith extending to the housing forward end includes an actuator switch to effect projection of pressurized gas therefrom. Such gas is typically in a form of nerve reacting gas typically known as Mace®.

4 Claims, 4 Drawing Sheets

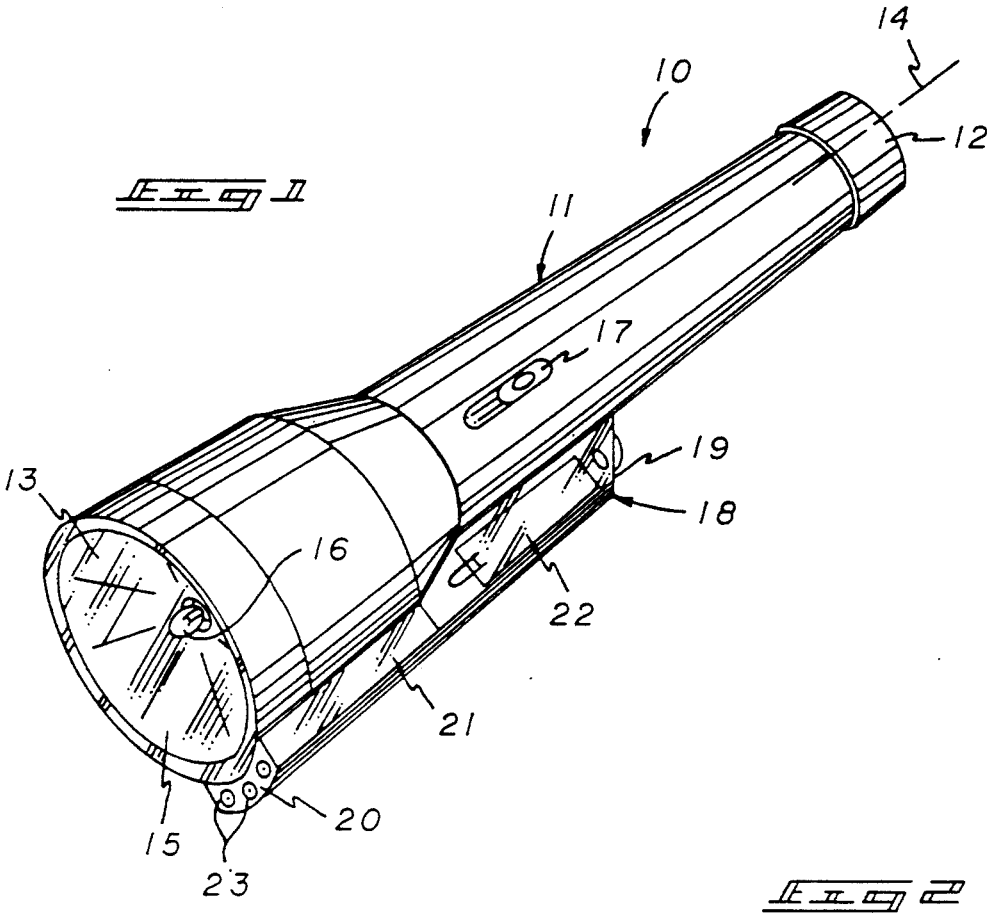
Fig 1
Fig 2
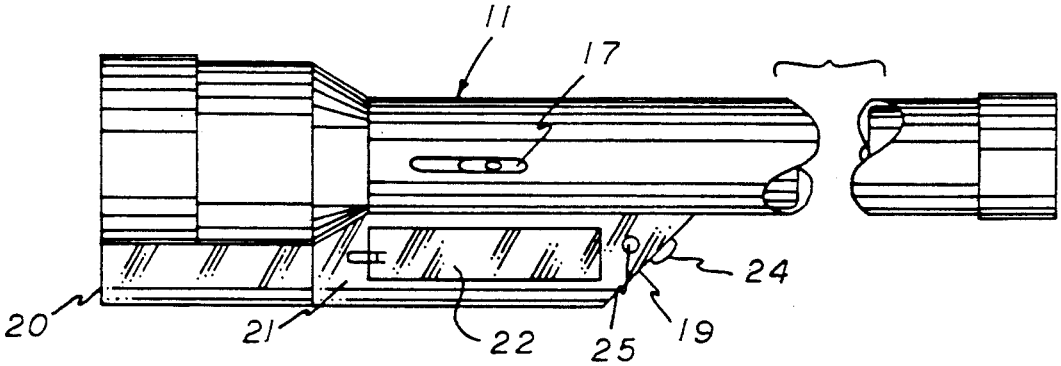
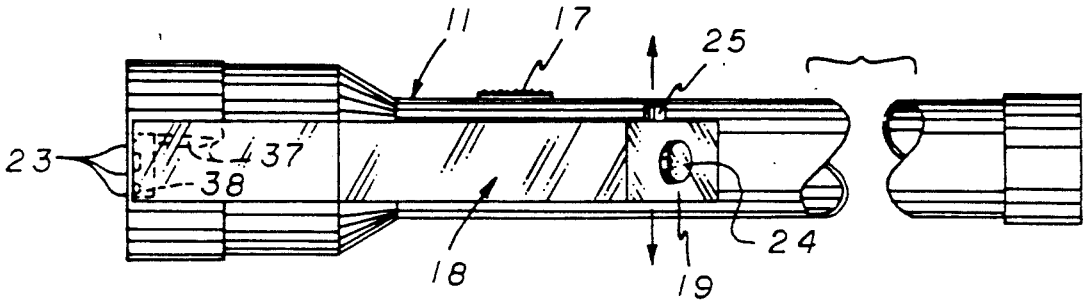
Fig 3

GAS DISPENSING FLASHLIGHT APPARATUS

BACKGROUND OF THE INVENTION

1. Field of the Invention

The field of invention relates to flashlight apparatus, and more particularly pertains to a new and improved gas dispensing flashlight apparatus wherein the same permits use of the flashlight as a self-defensive weapon in the dispensing of a nerve reacted gas.

2. Description of the Prior Art

Flashlight apparatus of various types are utilized in the prior art as indicated in the U.S. Pat. Nos. 5,016,148; 5,086,377; and wherein U.S. Pat. No. 3,443,333 to Manatos sets forth a tear gas palm pistol arranged for projection of tear gas therefrom.

The instant invention attempts to overcome deficiencies of the prior art by providing for a flashlight arranged to combine the employment of a nerve reactant gas such as Mace ® particularly for use in law enforcement scenarios and in this respect, the present invention substantially fulfills this need.

SUMMARY OF THE INVENTION

In view of the foregoing disadvantages inherent in the known types of flashlight apparatus now present in the prior art, the present invention provides a gas dispensing flashlight apparatus arranged to permit the selective projection of a disabling gas from the flashlight relative to an attacker and the like. As such, the general purpose of the present invention, which will be described subsequently in greater detail, is to provide a new and improved gas dispensing flashlight apparatus which has all the advantages of the prior art flashlight apparatus and none of the disadvantages.

To attain this, the present invention provides a flashlight having a primary housing, including an illumination bulb operative through a switch member relative to the housing, wherein a secondary housing arranged parallel to the access of the first primary housing in contiguous communication therewith extending to the housing forward end includes an actuator switch to effect projection of pressurized gas therefrom. Such gas is typically in a form of nerve reacting gas typically known as Mace ®.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gas dispensing flashlight apparatus which has all the advantages of the prior art flashlight apparatus and none of the disadvantages.

It is another object of the present invention to provide a new and improved gas dispensing flashlight apparatus which may be easily and efficiently manufactured and marketed.

It is a further object of the present invention to provide a new and improved gas dispensing flashlight apparatus which is of a durable and reliable construction.

An even further object of the present invention is to provide a new and improved gas dispensing flashlight apparatus which is susceptible of a low cost of manufacture with regard to both materials and labor, and which accordingly is then susceptible of low prices of sale to the consuming public, thereby making such gas dispensing flashlight apparatus economically available to the buying public.

Still yet another object of the present invention is to provide a new and improved gas dispensing flashlight apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention.

FIG. 2 is an orthographic side view of the invention.

FIG. 3 is an orthographic bottom view of the invention.

DESCRIPTION OF THE PREFERRED EMBODIMENT

Figure 4:
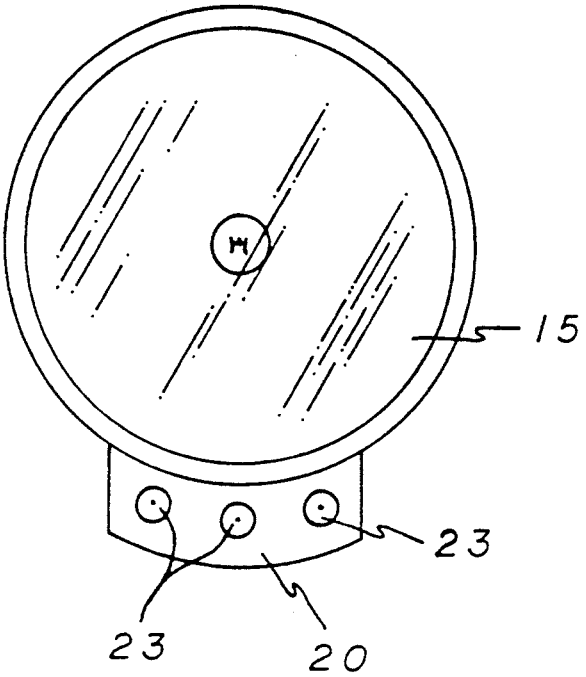
FIG. 4 is an orthographic frontal view of the invention.
Figure 5:
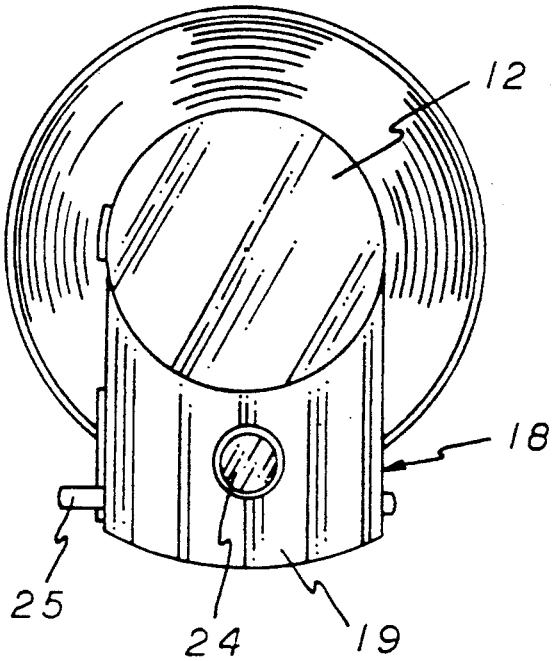
FIG. 5 is an orthographic rear view of the invention.
Figure 6:
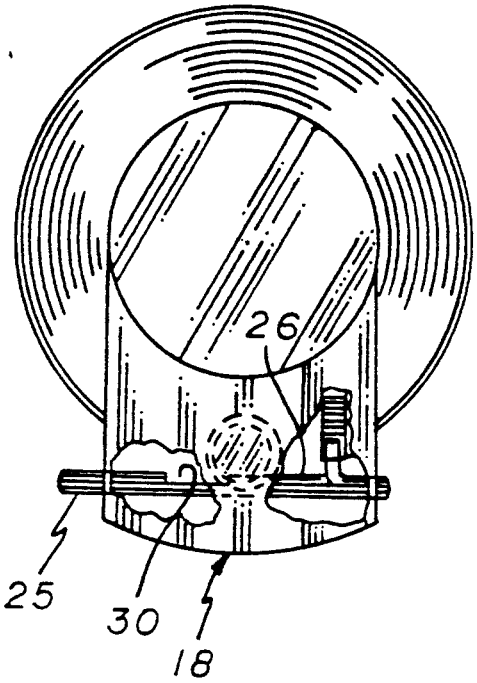
FIG. 6 is an orthographic rear view of the invention, partially in section, to indicate the slide safety structure.
Figure 7:
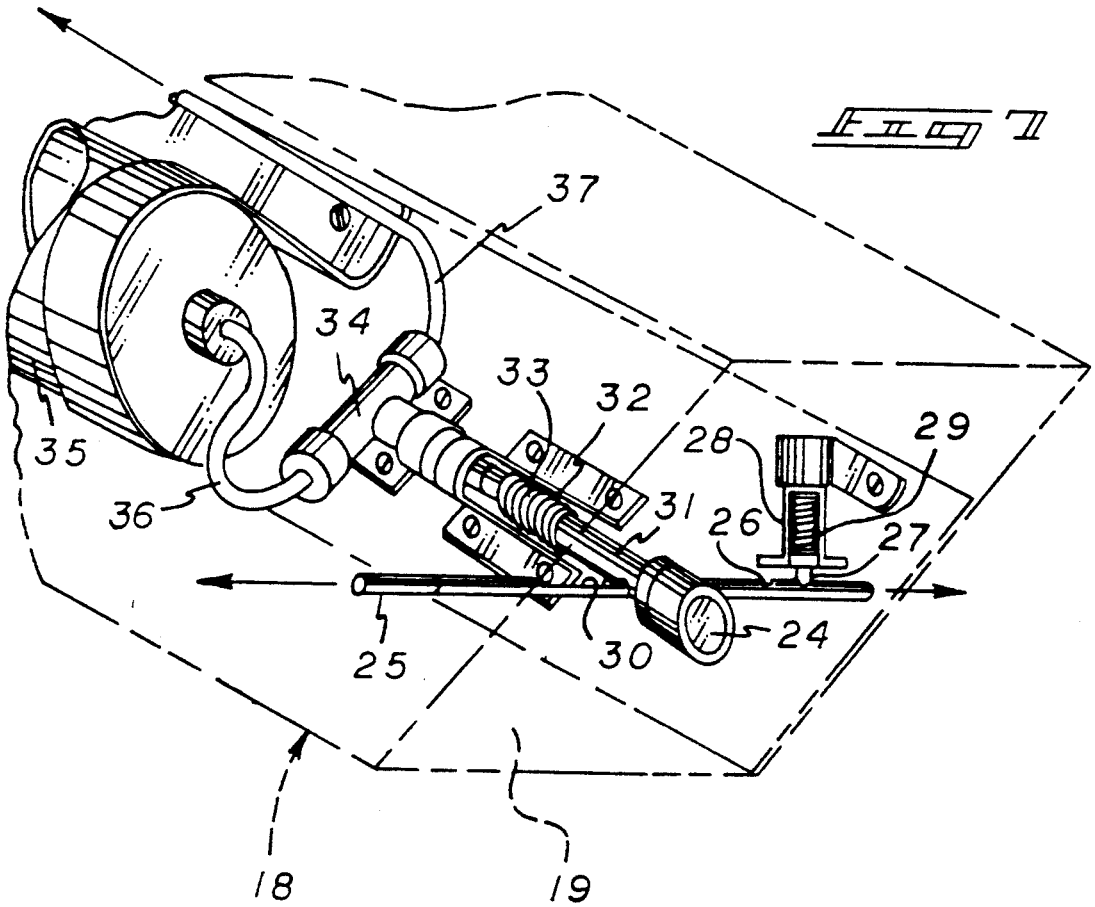
FIG. 7 is an isometric illustration of the invention indicating the slide safety structure in cooperation with the gas dispensing valve structure.

With reference now to the drawings, and in particular to FIGS. 1 to 9 thereof, a new and improved gas dispensing flashlight apparatus embodying the principles and concepts of the present invention and generally designated by the reference numeral 10 will be described.

More specifically, the gas dispensing flashlight apparatus 10 of the instant invention essentially comprises a primary housing 11, having a first end cap 12 removably mounted relative to the first end of the primary housing 11 to permit insertion of various batteries therewithin along the housing axis 14 to permit selective illumination of illumination bulb 16 mounted coaxially of a reflector lens 15 mounted spaced from the housing second end lens 13 orthogonally oriented relative to the axis 14, with the batteries operative through a switch 17 in a known manner per se. A secondary housing 18 is fixedly mounted to an exterior surface of the primary housing 11 parallel to the axis 14, having a secondary housing first end 19 spaced from a housing second end 20, that in turn is substantially in adjacency and extending to the primary housing second end mounting the second end lens 13. The secondary housing 18 further includes secondary housing side walls 21, one of which includes a door plate 22 permitting insertion of a gas canister 35 (see FIG. 7) within the housing as a reservoir for directing gas through associated valving (to be discussed in more detail below) for projection of such gas through the gas ports 23 directed through the secondary housing second end 20. Gas to be employed is contemplated as Mace (®), wherein reactive gases such as Teargas may be utilized.

An actuator button 24 is mounted through the secondary housing first end 19 permitting orientation of the actuator button 24 in a convenient orientation relative to an individual's hand grasping the primary housing 11. The secondary housing first end 19 is oriented in a canted orientation relative to the axis 14 to provide for an individual's fingers to extend slidingly over the secondary housing first end 19 in further grasping of the primary and secondary housings in a unitary manner by an individual's hand. A safety slide 25 orthogonally oriented relative to the actuator button 24 and the actuator button actuator rod 31 within the secondary housing 18 is provided. The safety slide 25 (see FIG. 7) includes a plurality of first recesses 26, wherein a plunger rod 27 orthogonally oriented relative to the safety slide 25 is received within one of said plurality of first recesses 26 to permit positioning of the safety slide in a safety or operative orientation permitting the actuator button 24 to be directed through an associated second recess 30 of the safety slide 25 when in the actuated position. The plunger rod 27 is mounted reciprocatably within a plunger rod housing 28 within the secondary housing 18, such that the plunger rod housing 28 includes a plunger rod spring 29 to project the plunger rod 27 from the plunger rod housing 28, with the plunger rod spring 29 captured between the plunger rod and the plunger rod housing 28.

The actuator rod 31 is reciprocatably directed through a guide tube 32, with the guide tube 32 having an actuator rod spring 33 mounted therewithin arranged to bias and project the actuator rod 31 from the guide tube 32 and project the actuator button 24 from the secondary housing first end 19. The actuator rod 31 is directed into a valve 34 to permit opening of the valve, whereupon gas flow from the gas canister 35 is permitted, wherein a first gas conduit 36 is in pneumatic communication with the gas canister 35 and the valve 34, wherein the second gas conduit 37 is directed between the valve 34 and a gas manifold 38 (see FIG. 3), with the gas manifold directing gas simultaneously through the gas ports 23.

Figure 8:
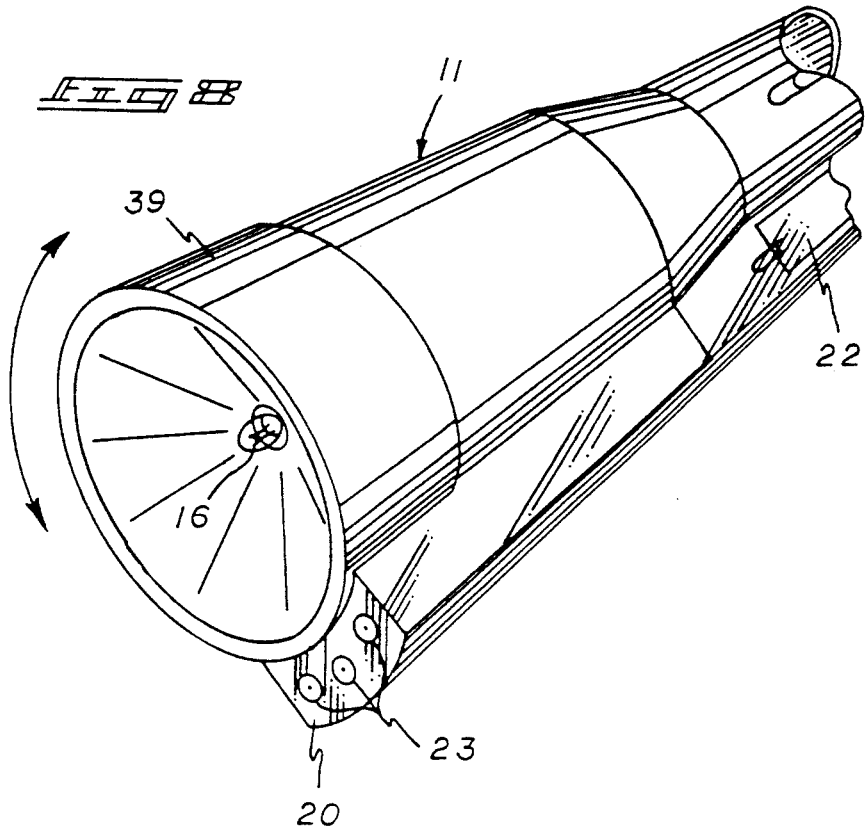
FIG. 8 is an isometric illustration of the housing including the rotary lens cap member.
Figure 9:
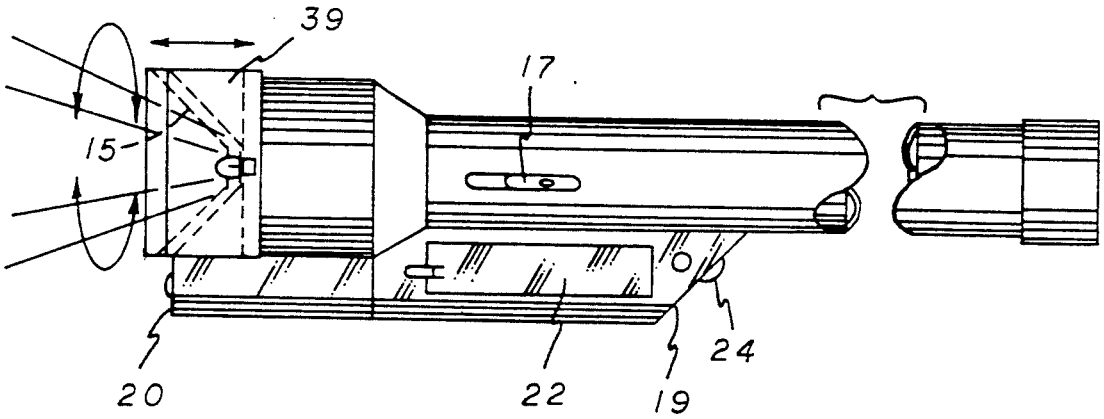
FIG. 9 is an orthographic side view of the invention and the associated rotary lens cap member relative to the flashlight housing.

The FIGS. 8 and 9 indicates the use of a rotary lens cap 39 mounting the lens reflector 15 fixedly thereto, with the reflector of a generally conical configuration arranged to permit extension and retraction of the reflector lens 15 within the primary housing 11 along the axis 14. The reflector lens is arranged to adjust the focusing of an associated light beam from the illumination bulb 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gas dispensing flashlight apparatus, comprising, a primary housing, having a housing first end and a housing second end, with the second end having a second end lens, the primary housing symmetrically oriented about a housing axis, and a reflector lens mounted within the primary housing in adjacency to the second end lens, with the reflector lens including an illumination bulb oriented medially thereof, with the reflector lens and the illumination bulb coaxially aligned relative to the axis, and a switch mounted to the primary housing to effect selective actuation of an illumination bulb, and a secondary housing, the secondary housing integrally mounted to the primary housing extending to the primary housing second end, with the secondary housing including a secondary housing first end and a secondary housing second end, the secondary housing first end including an actuator button, and the secondary housing second end including at least one gas port directed therethrough, and gas dispensing means mounted within the secondary housing operative through the actuator button to effect dispensing of said gas through said at least one gas port, and the secondary housing first end includes a second end canted wall obliquely oriented relative to said axis to permit ease of manual displacement of an individual's hand along said secondary housing second end, and the gas means includes a gas canister mounted within said secondary housing, the secondary housing further including a door to permit selective replacement of said gas canister, and a pneumatic valve mounted within said secondary housing in pneumatic communication with said gas canister, and said actuator button including an actuator rod extending from said actuator button to said pneumatic valve, with said pneumatic valve in pneumatic communication with said gas port to permit selective gas flow from said gas canister through said gas port upon projection of said actuator button within said secondary housing, and the pneumatic valve includes a first gas conduit effecting pneumatic communication between the pneumatic valve and the gas canister, and a second gas conduit mounted in pneumatic communication with said pneumatic valve, and a gas manifold, the gas manifold mounted within said secondary housing in adjacency to said secondary housing second end, including a plurality of further gas ports, wherein said gas port and said plurality of further gas ports are in pneumatic communication with the gas manifold.

2. An apparatus as set forth in claim 1 wherein the actuator button includes the actuator rod extending between said actuator button and said pneumatic valve, the actuator rod slidably received within a guide tube, and an actuator rod spring mounted within said guide tube to bias the actuator rod from said guide tube and said actuator button exteriorly of said secondary housing.

3. An apparatus as set forth in claim 2 wherein said secondary housing includes a plurality of secondary housing side walls, and a safety slide orthogonally directed through said side walls in adjacency to said actuator button, wherein said safety slide includes a plurality of first recesses, and a plunger rod orthogonally oriented relative to said safety slide, the plunger rod telescopingly received within a plunger rod housing, with said plunger rod housing mounted within said secondary housing, and a plunger rod spring captured between said plunger rod housing and said plunger rod to bias said plunger rod into communication with one of said plurality of first recesses.

4. An apparatus as set forth in claim 3 wherein said safety slide includes a second recess, wherein said second recess is spaced from said actuator button in a first position when said plunger rod is within one of said first recesses to prevent projection of said actuator button within said secondary housing, and wherein said second recess is in a facing relationship relative to said actuator button to permit projection of said actuator button through said secondary recess effecting projection of said actuator rod to said pneumatic valve to effect opening of said pneumatic valve and permitting flow of gas from said gas canister through said first gas conduit, said pneumatic valve, and said second gas conduit into said gas manifold.

* * * * *